US009693143B2

(12) United States Patent
Böhm et al.

(10) Patent No.: US 9,693,143 B2
(45) Date of Patent: Jun. 27, 2017

(54) MULTI-LAYER LAMINATE WITH HIGH INTERNAL DAMPING

(71) Applicant: TESA SE, Norderstedt (DE)

(72) Inventors: Nicolai Böhm, Hamburg (DE); Michael Egger, Hamburg (DE); Mark Hänle, Hamburg (DE); Alexander Herrmann, Hamburg (DE); Bernhard Müssig, Seevetal (DE); Andreas Westphal, Neu Wulmstorf (DE); Falk Hunger, Lüneburg (DE); Gero Maatz, Hamburg (DE)

(73) Assignee: TESA SE, Norderstedt (DE)

( * ) Notice: Subject to any disclaimer, the term of this patent is extended or adjusted under 35 U.S.C. 154(b) by 0 days.

(21) Appl. No.: 15/103,155

(22) PCT Filed: Nov. 27, 2014

(86) PCT No.: PCT/EP2014/075765

§ 371 (c)(1),
(2) Date: Jun. 9, 2016

(87) PCT Pub. No.: WO2015/086330

PCT Pub. Date: Jun. 18, 2015

(65) Prior Publication Data

US 2016/0309260 A1 Oct. 20, 2016

(30) Foreign Application Priority Data

Dec. 11, 2013 (DE) ..... 10 2013 225 665

(51) Int. Cl.
*H04R 7/10* (2006.01)
*H04R 31/00* (2006.01)

(52) U.S. Cl.
CPC ..... *H04R 7/10* (2013.01); *H04R 31/003* (2013.01); *H04R 2307/025* (2013.01)

(58) Field of Classification Search
CPC ... H04R 7/10; H04R 31/003; H04R 2307/025
USPC ..... 181/167, 173
See application file for complete search history.

(56) References Cited

U.S. PATENT DOCUMENTS

| | | | | |
|---|---|---|---|---|
| 4,728,561 | A | 3/1988 | Crocker | |
| 7,726,441 | B2 | 6/2010 | Uryu et al. | |
| 7,913,808 | B2 * | 3/2011 | Fehervari | H04R 31/003 181/157 |
| 8,141,676 | B2 | 3/2012 | Shen | |
| 8,284,964 | B2 | 10/2012 | Windischberger et al. | |

(Continued)

FOREIGN PATENT DOCUMENTS

| | | | |
|---|---|---|---|
| DE | 41 40 499 | A1 | 6/1993 |
| DE | 10 2007 030 665 | A1 | 1/2009 |

(Continued)

*Primary Examiner* — Forrest M Phillips
(74) *Attorney, Agent, or Firm* — Norris McLaughlin & Marcus P.A.

(57) ABSTRACT

The invention relates to a multi-layer composite for the production of membranes for electroacoustic transducers, comprising a first and second cover layer, a first and second damping layer and a separating layer, the first and the second damping layer consisting of adhesive compositions the respective glass transition temperatures TG (DSC) of which differ by at least 10 K.

13 Claims, 2 Drawing Sheets

(56) References Cited

U.S. PATENT DOCUMENTS

| | | | | |
|---|---|---|---|---|
| 8,496,086 | B2 * | 7/2013 | Gerkinsmeyer | H04R 7/10 181/169 |
| 9,475,966 | B2 * | 10/2016 | Ellringmann | B41N 6/02 |
| 2004/0112672 | A1 * | 6/2004 | Ono | H04R 7/125 181/169 |
| 2009/0304225 | A1 * | 12/2009 | Kamimura | H04R 7/127 381/423 |
| 2010/0040246 | A1 | 2/2010 | Windischberger et al. | |
| 2010/0288579 | A1 | 11/2010 | Gerkinsmeyer | |
| 2011/0026757 | A1 * | 2/2011 | Takahashi | H04R 7/125 381/397 |
| 2011/0155501 | A1 * | 6/2011 | Chen | H04R 7/06 181/167 |
| 2011/0272208 | A1 * | 11/2011 | Shen | H04R 7/10 181/170 |
| 2015/0125692 | A1 | 5/2015 | Müssig et al. | |

FOREIGN PATENT DOCUMENTS

| | | | |
|---|---|---|---|
| DE | 10 2012 208 477 | A1 | 11/2013 |
| EP | 0 191 979 | A2 | 8/1986 |
| WO | 2008/056287 | A1 | 5/2008 |

* cited by examiner

MULTI-LAYER LAMINATE WITH HIGH INTERNAL DAMPING

This application is a 371 of International Patent Application No. PCT/EP2014/075765, filed Nov. 27, 2014, which claims foreign priority benefit under 35 U.S.C. §119 of German Patent Application No. 10 2013 225 665.5, filed Dec. 11, 2013, the disclosures of which patent applications are incorporated herein by reference.

The invention relates to a multilayer assembly with high internal damping for producing membranes for electroacoustic transducers.

In cellphones and smartphones, for the reproduction of speech, ringtones, music, etc., sound is generated by small electroacoustic transducers, referred to as micro-loudspeakers. The size of the membranes in such micro-loudspeakers, which are also used in headphones, notebook computers, LCD TVs, or personal digital assistants (PDAs), is typically in the 20 $mm^2$ to 900 $mm^2$ range.

Owing to the design requirements asked of the corresponding electronic devices, micro-loudspeakers are becoming ever smaller and flatter, but at the same time are also being operated with higher power, meaning that the temperature load on the micro-loudspeaker and especially on its membrane is increasing continually. The membrane must therefore be fabricated from a material which has a long life and does not rupture even at high temperatures and under severe mechanical loads. At the same time, however, the membrane material ought also to have good acoustic properties, in order to endow the loudspeaker with high sound quality.

The general requirements of the material of a loudspeaker membrane are, first, high stiffness and low density, in order to generate a high acoustic pressure and to cover a wide frequency range. Furthermore, the material ought at the same time to have high internal damping, in order to ensure smooth frequency response and to minimize distortions. Since the properties of stiffness, light weight, and good damping result in a constructional contradiction, and cannot all be met simultaneously (the greater the stiffness, the lower the damping, and vice versa), it is necessary generally, with any membrane, to enter into compromise regarding the stiffness and the damping of the membrane material, or to combine stiff materials with materials having good damping qualities. Thus U.S. Pat. No. 7,726,441 B describes a membrane composed of a multilayer assembly of two stiff polymer films and a damping layer of adhesive situated between these films. Specifications DE 10 2007 030 665 A and U.S. Pat. No. 8,141,676 B each describe a five-layer assembly, in which two outer layers and a middle layer are separated from one another by a thermoplastic adhesive or an acrylic adhesive, respectively. In multilayer membranes of this kind, the same adhesives in the same thicknesses are used for each of the two adhesive layers. The reason for this is that the membrane in the loudspeaker ought to vibrate with maximum symmetry and uniformity, and an asymmetric construction in relation to the damping layers of adhesive can easily result in distortions, which would diminish the quality of the loudspeaker. Moreover, the acoustic properties of a loudspeaker may be heavily dependent on the particular side by which membranes of asymmetric construction that are used are fastened to the coil. Symmetrical membranes have therefore become established in use for loudspeakers, in order to prevent quality deviations as a consequence of incorrect installation of the membrane.

It is an object of the invention to present membranes, particularly for the production of loudspeakers, especially micro-loudspeakers, which are further optimized in terms of their damping properties and which nevertheless have good stiffness.

It has been possible to achieve this object by means of membranes of the kind set out in the claims. It has emerged in accordance with the invention that the internal damping of a multilayer membrane constructed from different layers of adhesive can be increased by comparison with the internal damping of a multilayer membrane composed of identical layers of adhesive, and that as a result the acoustic quality of a loudspeaker comprising such a membrane is enhanced. For the desired profile of properties, however, a partitioning interlayer is necessary between the adhesives, even when these adhesives are not miscible with one another and for that reason alone would take the form of two separate layers.

The invention relates accordingly to a multilayer assembly, especially for producing membranes for electroacoustic transducers, comprising first and second outer layers, first and second damping layers, and a parting layer, characterized in that the first and second damping layers consist of adhesives whose glass transition temperatures are at least 10 K, preferably 20 K, apart.

BRIEF DESCRIPTION OF THE DRAWINGS

The invention will now be described in greater detail with reference to the drawings, wherein:

FIG. 2 shows a plot course example with maximum of $f_0$ to illustrate the evaluation made as described hereinbelow; and.

Figure 1:
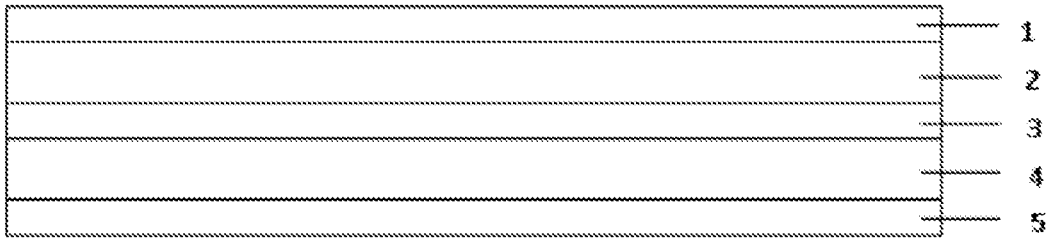
FIG. 1 depicts a multilayer assembly of the invention with high internal damping for producing membranes for electroacoustic transducers.

A multilayer assembly is the term used herein to identify a material, more particularly a material of two-dimensional extent, which consists of a plurality of layers disposed one above another. The different layers in the assembly may be joined to one another by techniques such as coextrusion, coating, or lamination, or by a combination of these techniques. A multilayer membrane is the term used herein to refer to a membrane, particularly for loudspeakers, wherein the membrane is produced by thermoforming, embossing, or other shaping techniques from a multilayer assembly.

Recognized as a key variable in assessing the quality of a loudspeaker membrane material, as well as the stiffness, is the internal damping of the material. The internal damping may be calculated from the oscillation behavior of the material, and represents a measure of the acoustic quality of the material. The higher the damping of the material, the better its acoustic quality.

A starting point of the present invention was the attempt to increase the internal damping of a three-layer assembly consisting of a polyetheretherketone (PEEK) film, a layer of adhesive, and a second PEEK film, with the layer of adhesive being disposed between the two PEEK films. PEEK is advantageous as a film material for three-layer assemblies of this kind because PEEK films exhibit very high temperature stability and lifetime. They are therefore frequently used, individually or as part of a multilayer assembly, for application as loudspeaker membranes.

Given that in an assembly of this kind composed of stiff outer films and soft layers of adhesive, the internal damping is influenced primarily by the layer of adhesive in the middle of the assembly, the aim was to clarify in a first experiment whether any increase in the internal damping can be achieved by using two different layers of adhesive one above another, which differ in their damping properties, rather than one intermediate layer of adhesive. This can be achieved by employing adhesives having different glass transition temperatures. The adhesive middle layer of a given thickness d in the three-layer assembly ought accordingly to be replaced by two layers of adhesive each of half the thickness, d/2, thus producing no change in the overall thickness of the middle layer. So that the two adhesives are present alongside one another in the assembly and so that their respective damping properties are manifested separately from one another, two mutually incompatible adhesives were selected for this approach, these being adhesives which are not miscible with one another. Alternatively, it would be possible for there to be mixing of both adhesives, as a result of which the adhesive mixture would behave, macroscopically, like a new adhesive. For this reason, two incompatible, mutually immiscible adhesives were applied separately each to a PEEK film 8 μm thick. The two films were subsequently laminated to one another by exertion of pressure, with the adhesive-coated sides pointing to one another, and so the two layers of adhesive lie one above another and are lined on both sides by the PEEK films.

In the experiment it emerged that the internal damping of an assembly of this kind of two PEEK films and two mutually incompatible adhesives could barely be improved by comparison with a three-layer assembly of equal thickness in which only one of the two adhesives was used in each case.

Very surprisingly, however, the insertion of an additional film layer between the two layers of adhesive resulted in a significant increase in the internal damping of the assembly. This is surprising insofar as control experiments indicated that the simple insertion of an additional film layer between two identical layers of adhesive in fact has an adverse effect on the internal damping. The reason for this effect observed with identical layers of adhesive probably lies in the increase in the stiffness of such an assembly, and it is therefore also foreseeable.

The effect observed in accordance with the invention, of the sharp increase in the internal damping in the case of the five-layer assembly with two different adhesives and an additional film layer, in contrast, cannot be based on a simple separation of the two adhesives, since the adhesives used were selected from the outset to be incompatible, ruling out the possibility of mixing per se. Nor can the effect be based purely on the insertion of an additional parting layer, since in the case of two identical adhesives this lowers the internal damping. The fact, therefore, that the specific combination of two immiscible adhesives and a parting layer in between gave a significant increase in the internal damping of such an assembly is completely unforeseeable.

It has emerged in accordance with the invention that a significant increase in the damping was even observable when the two adhesives separated from one another by an additional layer, while miscible in principle, in fact had different glass transition temperatures.

The glass transition temperature is determined by Dynamic Scanning calorimetry (DSC) in accordance with DIN 53765. The figures for the glass transition temperature $T_g$ are based on the glass transformation temperature value $T_g$ according to DIN 53765:1994-03, unless specifically indicated otherwise. A multilayer assembly of the invention with high internal damping for producing membranes for electroacoustic transducers is shown in FIG. 1. An assembly of this kind comprises a first outer layer 1, a first damping layer 2, a parting layer 3, a second damping layer 4, and a second outer layer 5.

As outer layers 1 and 5 it is possible, for example, to use polymeric films whose principal constituent (more particularly at least 50 wt %, preferably exclusively) is selected from the group of polyethylene terephthalate (PET), polycarbonate (PC), polybutylene terephthalate (PBT), polyethylene naphthalate (PEN), polyetheretherketone (PEEK), polyetherketone (PEK), polyaryletherketone (PAEK), polyetherimide (PEI), polyimide (PI), polyarylate (PAR), polyphenylene sulfide (PPS), polyphenylsulfone (PPSU), polysulfone (PSU), polyethersulfone (PES), polyurethane (PU), liquid-crystal polymer (LCP). Metal foils such as aluminum foils, for example, may also be used. The films may have been produced as flat films or with biaxial orientation. Outer layers of polyetheretherketone have emerged as being particularly preferred.

Suitable in principle as parting layer 3 are likewise films whose principal constituent (especially at least 50 wt %, preferably exclusively) is selected from the group of polyethylene terephthalate (PET), polycarbonate (PC), polybutylene terephthalate (PBT), polyethylene naphthalate (PEN), polyetheretherketone (PEEK), polyetherketone (PEK), polyaryletherketone (PAEK), polyetherimide (PEI), polyimide (PI), polyarylate (PAR), polyphenylene sulfide (PPS), polyphenylsulfone (PPSU), polysulfone (PSU), polyethersulfone (PES), polyurethane (PU), liquid-crystal polymer (LCP).

Since oscillation causes less mechanical loading of the parting layer than of the outer layers, and since softening of the parting layer on heating may even be an advantage, it is additionally possible, for the parting layer, to use films of materials that are not so temperature-stable as well. Alternatively to the materials already stated, the film of the parting layer may consist of plastics whose principal constituent is selected from the group of polyethylene [PE, LDPE (low density PE), MDPE (medium density PE), HDPE (high density), LLDPE (linear low density PE), VLDPE (very low density PE)], EVA (ethylene-vinyl acetate), polypropylene (PP, PP homopolymer, PP random copolymer, PP impact copolymer), polystyrene [PS, HI-PS (high impact PS)], EPDM (ethylene-propylene-diene terpolymers), styrene block copolymers [SBS (styrene-butadiene-styrene), SEBS (styrene-ethylene-butylene-styrene), SIS (styrene-isoprene-styrene), SEPS (styrene-ethylene-propylene-styrene)]. Likewise possible is the use of nonwovens and woven fabrics, papers, or foams.

The outer layers may consist of the same material or of different material, and the material of the parting layer may in principle be selected independently of the materials of the outer layers. However, the parting layer may also consist of the same material as one of the two outer layers or as both outer layers. The parting layer 3, first outer layer 1, and second outer layer 5 may alternatively all consist of different materials.

The thicknesses of the two outer layers and of the parting layer are independent of one another and are situated in the 1-100 μm range, preferably 1-50 μm, more preferably 2-30 μm. The thickness of the layers can be determined using a thickness gauge (DIN 53370:2006-11, method F; standard conditions). For this purpose, for films, a disk-shaped gauge (circular) having a diameter of 10 mm is used, with an applied weight of 4 N.

Employed as damping layers 2 and 4 are adhesives, preferably pressure-sensitive adhesives (PSAs). These may be resin-modified acrylate PSAs, acrylate dispersions, synthetic rubber PSAs, silicone PSAs, PU PSAs, etc.

The thicknesses of damping layers 2 and 4 independently of one another are 1-100 μm, preferably 2-50 μm, more preferably 4-30 μm. The thickness of the two damping layers is typically greater than the thickness of the outer layers and than the thickness of the parting layer.

The glass transition temperatures of the two layers 2 and 4 of adhesive as measured by DSC (method as specified in this text) are at least 10 K, preferably at least 15 K, more preferably at least 20 K apart.

The assembly may have an asymmetric geometry in the sense that the thicknesses of the two outer layers and/or the thicknesses of the two damping layers are selected to be different, with preferably at least one of the outer layers and/or at least one of the damping layers selected within the respective thickness range identified above, and very preferably with both outer layers and/or both damping layers selected within the respective thickness range identified above.

Irrespective of the different nature of the damping layers, the assembly preferably has a symmetrical geometry in the sense that at least the two outer layers possess identical thickness and/or at least the two damping layers possess identical thickness; these thicknesses are selected more particularly from the respective thickness ranges identified above.

In the case of one particularly preferred embodiment, the two outer layers and the parting layer each possess the same thickness, and both damping layers as well have identical thickness (which may correspond but need not necessarily correspond to the thickness of the outer layer and parting layer). More preferably the thicknesses are selected from the ranges specified above in each case.

In a further preferred embodiment, the outer layers have identical thicknesses, and the damping layers as well both have the same thickness, with the parting layer being thinner than each of the outer layers.

EXAMPLES

The internal damping of the multilayer assemblies was determined in accordance with the Oberst beam test for measuring the vibration-damping properties of materials in accordance with ASTM E756, specifically as follows:

A strip of the laminate 10 mm wide and 50 mm long was clamped at one end in such a way as to allow it to oscillate in free suspension in a length of 15 mm. The strip was clamped in parallel to the edge measuring 10 mm, with the strip hanging vertically downward by the edge 15 mm long. The strip was subsequently excited into oscillation by soundwaves through a loudspeaker located immediately behind the strip. The frequency of the soundwaves was increased continuously from 2 Hz to 2000 Hz, and the deflection of the freely oscillating strip was recorded with a laser during this process. The laser was adjusted for this purpose such that its beam impinges on the strip 3 mm from the lower strip edge, perpendicularly and centrally. The deflection of the strip in oscillation by laser is determined according to the known principle of laser triangulation. (Instead of acoustic excitation, the strip could also be induced to oscillate purely mechanically, by means of a motor; the principle of the method remains the same.)

For evaluation, the quotient formed from strip deflection and acoustic pressure measured is plotted against the frequency. The deflection is determined as described above with a laser, and at the same time the frequency and acoustic pressure of the soundwaves generated by the loudspeaker are recorded with a microphone. In the resulting plot, each strip attains a maximum at a frequency which is characteristic and is specific for the particular multilayer assembly under investigation. The frequency at which this maximum is obtained is termed the resonant frequency $f_0$. Likewise specific and characteristic for the multilayer assembly is the course of the plot around this maximum. From this plot course it is possible to derive the internal damping of the multilayer assembly: a steep increase and drop in the deflection of the strip in front of and behind the resonant frequency corresponds to low internal damping, while a flat plot profile around the maximum at $f_0$ corresponds to high internal damping. The internal damping η is computed from the −4 dB bandwidth $\Delta_{4dB}$ of the plot, in other words from the width of the 4 dB peak beneath the plot maximum. The width of the peak at this point in Hz, divided by the resonant frequency $f_0$, gives the internal damping η:

$$\eta=\Delta_{4dB}/f_0$$

Figure 2:
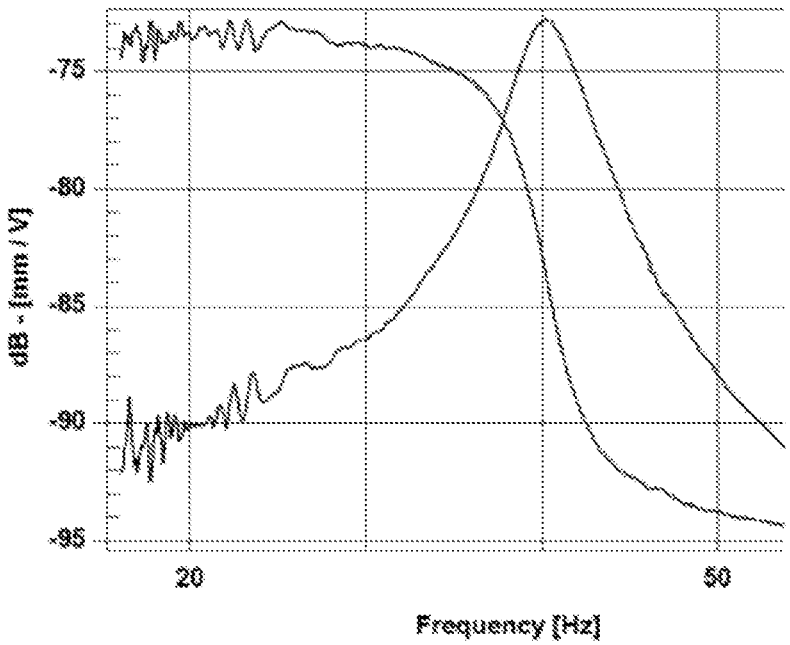
Figure 3:
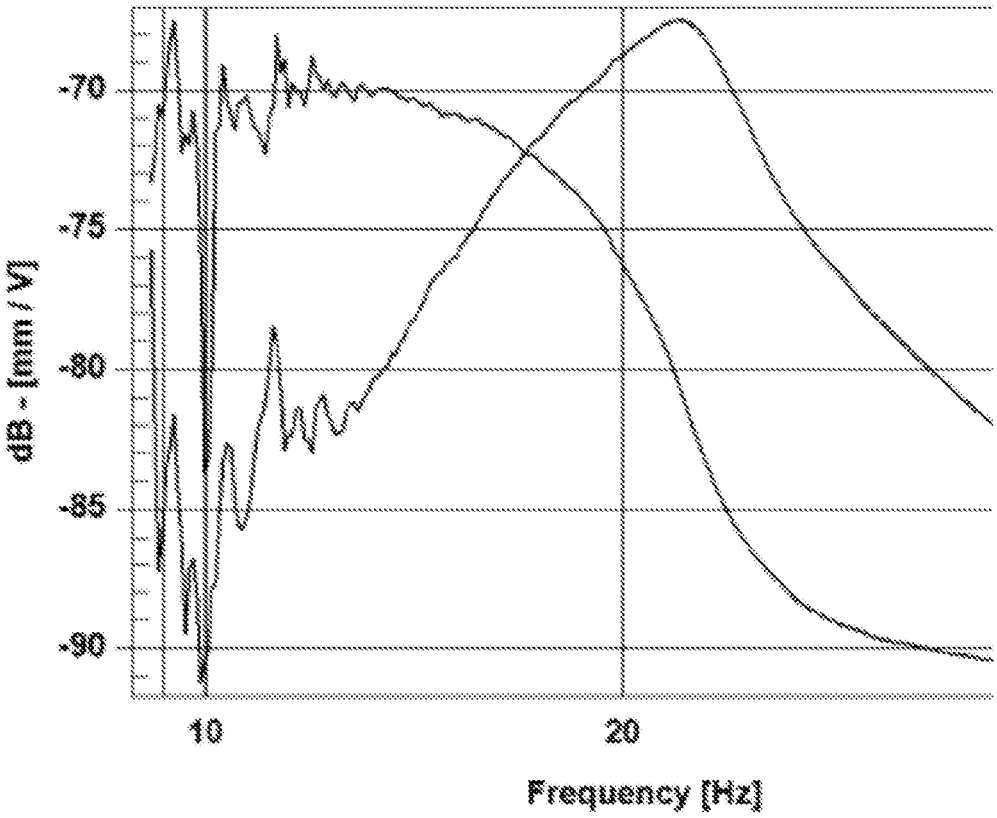
FIG. 3 shows a plot course example with maximum of $f_0$ to illustrate the evaluation made as described hereinbelow.

FIGS. 2 and 3 each show a plot course example with maximum of $f_0$ to illustrate the evaluation. The relatively flat course around the maximum in the right-hand picture shows the higher internal damping of the assembly in question.

All measurements took place at a temperature of 23° C.; the sample strips were stored and conditioned at 23° C. for 24 hours prior to measurement. The results relate in each case to the average from five measurements per specimen.

Inventive Example 1

A three-layer assembly was produced from PEEK film 8 μm thick (Aptiv 1000-008G, from Victrex), a 30 μm thick layer of a polyacrylate adhesive with $T_g$=−44° C. by DSC (DIN 53765), and a PEEK film 8 μm thick. The figure for the internal damping was η=0.12.

Inventive Example 2

A three-layer assembly was produced from PEEK film 8 μm thick, a 30 μm thick layer of a polyacrylate adhesive with $T_g$=−23° C. by DSC (DIN 53765), and a PEEK film 8 μm thick. The figure for the internal damping was η=0.11.

Comparative Example 1

A PEEK film 8 μm thick was coated with 15 μm of a polyacrylate adhesive as described for inventive example 1 ($T_g$=−44° C.). A second PEEK film 8 μm thick was coated with 15 μm of a polyacrylate adhesive as described for inventive example 2 ($T_g$=−23° C.). The adhesives used were selected so as not to be miscible with one another. The two assemblies of the respective adhesive and the PEEK film were laminated to one another at room temperature by the adhesive sides, with exertion of pressure, ensuring that no air bubbles were included between the two layers of adhesive. The figure for the internal damping was η=0.13.

Comparative Example 2

A PEEK film 8 μm thick was coated with 15 μm of a polyacrylate adhesive as described for inventive example 1 ($T_g$=−44° C.). A second PEEK film 8 μm thick was likewise coated with 15 μm of a polyacrylate adhesive as described for inventive example 1 ($T_g$=−44° C.). One each of the two assemblies of adhesive-coated PEEK film was laminated by the adhesive side to one each of the two sides of a PET film 2 μm thick, thus resulting in a five-layer assembly of 8 μm PEEK film, 15 μm polyacrylate adhesive ($T_g$=−44° C.; cf.

inventive example 1), 2 μm PET film, 15 μm polyacrylate adhesive ($T_g$=−44° C.; cf. inventive example 1), and 8 μm PEEK film. The figure for the internal damping was η=0.08.

Inventive Example 3

A PEEK film 8 μm thick was coated with 15 μm of a polyacrylate adhesive as described for inventive example 1 ($T_g$=−44° C.). A second PEEK film 8 μm thick was coated with 15 μm of a polyacrylate adhesive as described for inventive example 2 ($T_g$=−23° C.). One each of the two assemblies of adhesive-coated PEEK film was laminated by the adhesive side to one each of the two sides of a PET film 2 μm thick, thus resulting in a five-layer assembly of 8 μm PEEK film, 15 μm polyacrylate adhesive ($T_g$=−44° C.; cf. inventive example 1), 2 μm PET film, 15 μm polyacrylate adhesive ($T_g$=−23° C.; cf. inventive example 2), and 8 μm PEEK film. The figure for the internal damping was η=0.19.

Compilation of Results:

| Specimen | Construction | Thickness | Internal damping η |
|---|---|---|---|
| Inv. ex. 1 | PEEK/polyacrylate 1/PEEK | 46 μm | 0.12 |
| Inv. ex. 2 | PEEK/polyacrylate 2/PEEK | 46 μm | 0.11 |
| Comp. ex. 1 | PEEK/polyacrylate 1/polyacrylate 2/PEEK | 46 μm | 0.13 |
| Comp. ex. 2 | PEEK/polyacrylate 1/PET/polyacrylate 1/PEEK | 48 μm | 0.08 |
| Inv. ex. 3 | PEEK/polyacrylate 1/PET/polyacrylate 2/PEEK | 48 μm | 0.19 |

In accordance with the invention it is apparent that the introduction of a film parting layer into the layer of adhesive in a three-layer assembly results in a deterioration in the internal damping (comparative example 2). The modification of a layer of adhesive in a three-layer assembly to form a double layer of two immiscible layers of adhesive, of half-thickness, having different glass transition temperatures, resulted only in a small improvement in damping (comparative example 1). Only when both measures were implemented was there, unforeseeably, a significant improvement in the internal damping of the assembly (inventive example 3).

The invention claimed is:

1. A multilayer assembly for producing membranes for electroacoustic transducers, comprising first and second outer layers, first and second damping layers, and a parting layer between said first and second damping layers, wherein the first and second damping layers comprise adhesives whose glass transition temperatures $T_g$ (DSC) differ by at least 10 K.

2. A multilayer laminate as claimed in claim 1, wherein the glass transition temperatures $T_g$ (DSC) of the adhesives of the first and second damping layers differ at least by 15 K.

3. The multilayer laminate as claimed in claim 1, wherein the first and/or second damping layers comprise a material whose principal constituent is selected from the group consisting of polyethylene terephthalate (PET), polycarbonate (PC), polybutylene terephthalate (PBT), polyethylene naphthalate (PEN), polyetheretherketone (PEEK), polyetherketone (PEK), polyetherimide (PEI), polyimide (PI), polyarylate (PAR), polyphenylene sulfide (PPS), polyphenylsulfone (PPSU), polysulfone (PSU), polyethersulfone (PES), polyurethane (PU), and liquid-crystal polymer (LCP).

4. The multilayer laminate as claimed in claim 1, wherein the thickness of the first and/or second outer layers is 1-100 μm.

5. The multilayer laminate as claimed in claim 1, wherein the parting layer comprises a material whose principal constituent is selected from the group consisting of:

polyethylene terephthalate (PET), polycarbonate (PC), polybutylene terephthalate (PBT), polyethylene naphthalate (PEN), polyetheretherketone (PEEK), polyetherketone (PEK), polyetherimide (PEI), polyimide (PI), polyarylate (PAR), polyphenylene sulfide (PPS), polyphenylsulfone (PPSU), polysulfone (PSU), polyethersulfone (PES), polyurethane (PU), and liquid-crystal polymer (LCP).

6. The multilayer laminate as claimed in claim 5, wherein the parting layer comprises a material whose principal constituent is selected from the group consisting of:

polyethylene [polyethylene (PE), LDPE (low density PE), MDPE (medium density PE), HDPE (high density), LLDPE (linear low density PE), VLDPE (very low density PE)], EVA (ethylene-vinyl acetate), polypropylene [polypropylene (PP), PP homopolymer, PP random copolymer, PP impact copolymer], polystyrenes [polystyrene (PS), HI-PS (high impact PS)], EPDM (ethylene-propylene-diene terpolymers), styrene block copolymers [SBS (styrene-butadiene-styrene), SEBS (styrene-ethylene-butylene-styrene), SIS (styrene-isoprene-styrene), and SEPS styrene-ethylene-propylene-styrene)].

7. The multilayer laminate as claimed in claim 1, wherein the parting layer comprises a nonwoven, a woven fabric, a paper or a foam, or a multilayer assembly of two or more layers of the aforesaid materials.

8. The multilayer laminate as claimed in claim 1, wherein the thickness of the parting layer is 1-100 μm.

9. The multilayer laminate as claimed in claim 1, wherein one or both damping layers are pressure-sensitive adhesives.

10. The multilayer laminate as claimed in claim 1, wherein one or both damping layers are hotmelt adhesives.

11. The multilayer laminate as claimed in claim 1, wherein the thickness of one or both damping layers is 1-100 μm.

12. A membrane obtainable by thermoforming, embossing, or other shaping techniques from a multilayer assembly as claimed in claim 1.

13. An electroacoustic transducer comprising a membrane according to claim 12.

* * * * *